US006972687B1

(12) United States Patent
Marshall et al.

(10) Patent No.: US 6,972,687 B1
(45) Date of Patent: Dec. 6, 2005

(54) SYSTEM AND METHOD FOR DETECTING A STRUCTURE FAILURE

(76) Inventors: Robert A Marshall, 324 Doe Run, Georgetown, TX (US) 78628; Fred R. Marshall, 1122 Post Rd., Carencro, LA (US) 70520

( * ) Notice: Subject to any disclaimer, the term of this patent is extended or adjusted under 35 U.S.C. 154(b) by 163 days.

(21) Appl. No.: 10/619,255

(22) Filed: Jul. 14, 2003

(51) Int. Cl.[7] ..... G08B 21/00
(52) U.S. Cl. ..... 340/686.1; 340/687; 14/78; 398/21
(58) Field of Search ..... 340/686.1, 665, 340/668, 915, 917, 931, 854.9, 855.1, 855.2, 340/686.2; 398/19–21; 14/78; 250/491.1

(56) References Cited

U.S. PATENT DOCUMENTS 4,843,372 A * 6/1989 Savino ..... 340/540
4,927,232 A * 5/1990 Griffiths ..... 385/13
RE35,020 E * 8/1995 Quinlan, Jr. ..... 385/13
5,479,150 A 12/1995 Schmidt et al.
6,495,819 B1 * 12/2002 Cerwin et al. ..... 250/227.19
6,647,161 B1 * 11/2003 Hodge ..... 385/12

OTHER PUBLICATIONS

State of Texas Department of Transportation Collapse Detecton and Warning System Jan. 7, 2003.

* cited by examiner

*Primary Examiner*—Brent A. Swarthout
*Assistant Examiner*—Eric Blount

(57) ABSTRACT

A system for quickly and reliably detecting a failed structure includes a signal source, a cable attached to the structure, an anti-slip cable anchor, a signal detector, and user indicator. When the structure fails, the cable attached to the structure is also broken. The user indicator is operable to display the status of the cable. The cable breaks due to exceeding the elastic modulus of the cable, caused by elongation of the distance between two fixed points caused by the failing structure. Electric power must be provided to each signal source, signal detector and user indicator.

38 Claims, 4 Drawing Sheets

SYSTEM AND METHOD FOR DETECTING A STRUCTURE FAILURE

TECHNICAL FIELD OF THE INVENTION

This invention relates generally to the field of transportation safety and, more specifically, to warning of a catastrophic structural failure by elongation of the path between two points.

BACKGROUND OF THE INVENTION

Any number of hazards may cause a structure, such as a span of a bridge or causeway, to fail. Some common hazards include collision by a boat, barge or train, earthquake, earth movement, flood, fatigue, aging or malicious activity.

Unfortunately, the consequences of such a failed bridge frequently include loss of life and property. Much of this loss of life or property is from vehicles nowhere near the affected portion of the structure at the time of failure. The vehicle operator is simply not aware of the hazard ahead and proceeds to drive over the edge of the failed bridge.

In many cases, the viewing angle of a failed bridge span limits the distance to which a motorist can visually see any trouble ahead. By the time the hazard is seen, the driver may not have adequate distance to come to a complete stop. These unfortunate motorists are doomed to plummet from the bridge. Worse yet, if the traffic density is low enough, the demise of the first driver will be unknown to subsequent drivers, still far away, soon to suffer the same fate under the exact same conditions. This spectacle has been known to continue for prolonged periods of time before the traffic flow can be stopped. Fishermen underneath the bridge can have a good viewing angle of the event but are generally powerless to warn oncoming motorists in an expedient and effective manner. Thus, a need has arisen for a system and method to detect a failed structure quickly and reliably.

Some automated systems have been implemented using a metallic conductor or a fiber optic cable as a failure detection sensor. These systems rely on the fact that a falling bridge will increase the distance between two fixed points sufficiently to break the cable. For example, one such system utilizes a metallic conductor such as a rail of a railway. A bridge may collapse from under the rail, stretching and deforming the rail, but not breaking the conductor. Therefore, no alarm is indicated. Another system utilizes a metallic link across every expansion joint, requiring each and every joint be monitored, increasing installation cost. Additionally, metallic conductors run over long bridges are subject to lightning damage and different ground voltage potentials between ends of a bridge. Another system relies on mechanically cutting a cable when the cable is put under tension, requiring moving parts and thus reducing reliability or increasing maintenance requirements. Yet another system exposes a few inches of the fibers within a straight run of fiber optic cable, which creates a weak point to break under sudden jerking of the cable. However, this system allows the fiber to creep within the cable sheath, introducing the possibly of the falling bridge to not stretch the cable, lengthened by creep, beyond the breaking point. This is due to the fiber optic buffer tubes having an extremely low coefficient of friction with the aramid yarn in a fiber optic cable. Other warning systems monitor for unusual vibrations of the structure or obstructions of a free space laser. These systems suffer from too many false alarms to maintain the trust of the driving public. Although telecommunication cables may be already attached to a bridge, they are not useful as structural failure indicators, because the time to alert drivers is extremely poor.

Another type of system described in U.S. Pat. No. 4,927,232, Griffiths, describes a fiber optic detection system capable of detecting a failed structure. Detection is based on measuring optical parameters of the fiber. While giving much more detailed structural information, it requires a special fiber optic cable and lacks the cost advantages of merely monitoring for a cable break.

Unnecessary loss of life and property can be significantly reduced with a reliable system to immediately and effectively detect and warn of a failed structure.

SUMMARY OF THE INVENTION

In accordance with the present invention, a system and method for detecting a failed structure is provided that addresses disadvantages and problems associated with other systems and methods.

A system for quickly and reliably detecting a failed structure includes a signal source, a cable attached to the structure, an anti-slip cable anchor, a signal detector, a controller, and a user indicator. The cable acts as an elongation sensor. When the structure fails, the cable attached to the structure is also broken. The cable breaks due to exceeding the elastic modulus of the cable, caused by elongation of the distance between the anti-slip cable anchors, as a result of the failing of the structure. The user indicator is operable to display the status of the cable. The fiber optic cable, optical signal source and optical signal detector are standard low cost telecommunications components. Electric power must be provided to each signal source, signal detector and user indicator.

In typical fiber optic cable, aramid yarn is applied between the cable sheath and the optical fibers. The aramid provides strength to the cable as well as a low friction slip layer, required to bend the cable without breaking the glass, since inner and outer radii are different. Optical glass fiber is very brittle and easily broken with a tight bend radius or shear forces. Wrapping the fiber optic cable around a spindle will give a minimum bend radius, anchor the cable, and arrest fiber creep due to greatly increased friction caused by the pressure of pulling the fiber around a corner. Tensile strength of a typical optical fiber is approximately 20 pounds. The tensile strength of a fiber optic cable is typically greater than 200 pounds. Spindles have no sharp edges to damage the fiber when tension is applied during normal use. Optionally, the sheath and aramid yarn may be severed, which will reduce the force on the spindles by reducing the tensile strength of the cable and will reduce slippage of the fibers within the sheath.

Typically fiber optic cable stretches about 0.3% of the length of the cable before the cable breaks. Significant variations in stretch exist between various cable models and manufacturers. The amount of elongation of the cable produced by structural collapse is limited by the distance the structure is capable of falling. Therefore, the structure must be divided into segments to ensure the cable elongation of a segment caused by the falling structure is greater than the elastic modulus of the optical fiber. This is especially important for longer structures, such as causeways. Each segment is terminated at both ends by a cable anchor. Otherwise, it is possible, but by no means guaranteed, for the bridge to collapse and come to rest on top of an unbroken but stretched fiber. Each fiber segment may cross multiple expansion joints. To provide additional assurance, the fiber may also be pre-stretched. This reduces the amount of bridge displacement and cable elongation required to break the cable. Alternatively, this increased sensitivity may be traded for an increased distance between cable anchors, reducing the number of cable anchors required.

The controller may incorporate the signal source and signal detector. The controller generates and responds to only modulated data signals. This prevents environmental noise, such as sunlight entering a broken fiber, from masking an alarm. The absence of modulated light arrival at the far end indicates a failure of the structure. On detection of a structural failure, a user indicator, such as a red traffic light, is activated.

The fiber may be segmented such that one or more controllers are located midspan on the structure. Midspan controllers allow for shorter pulls of fiber optic cable into a conduit attached to the structure. One or more user indicators may be coupled to one controller.

Energy storage may be provided at each controller or at each user indicator. The battery supplies electricity to each user indicator only when the indicator is active. Key advantages include that the electric power conductors may be sized to handle the relatively small quiescent load of the controller and a slow battery charge, rather than the full power of all user indicators; and any electrical fault in the power wiring introduced during bridge failure will not unnecessarily disable any user indicators when functionality is most required. Specifically, an event such as an earthquake may cause multiple failures on a structure, disabling utility power to user indicators located between the multiple failures, which need to be on. The controller may also report battery status and perform battery tests.

Examples of a structure monitored for catastrophic failure may include a causeway, automobile bridge, railway bridge, pipeline bridge or pedestrian bridge. Common causes of failure include collision by a boat, barge, train, or earthquake, earth shift, excessive water flow, or mechanical failure. A bridge structure may be constructed of concrete or steel. The steel bridge monitor may also include an inclinometer attached to each span, since steel spans tend to twist long before catastrophic failure. The steel span must also have the fiber optic cable attached across critical failure points, resulting in a cable that is not straight, but rather interconnecting monitored points. Additionally, the structure may be a roadway monitored for sinkholes; a tunnel; a well, or mine monitored for collapse; a dam monitored for catastrophic failure; or a path monitored with a tripwire.

Other technical advantages are readily apparent to one skilled in the art from the following figures, descriptions, and claims.

BRIEF DESCRIPTION OF THE DRAWINGS

For a more complete understanding of the invention, and for further features and advantages, reference is now made to the following description, taken in conjunction with the accompanying drawings, in which.

DETAILED DESCRIPTION OF EMBODIMENTS OF THE INVENTION

Embodiments of the present invention and their advantages are best understood by referring to FIGS. 1 through 4 of the drawings, in which like numerals refer to like parts.

Figure 1:
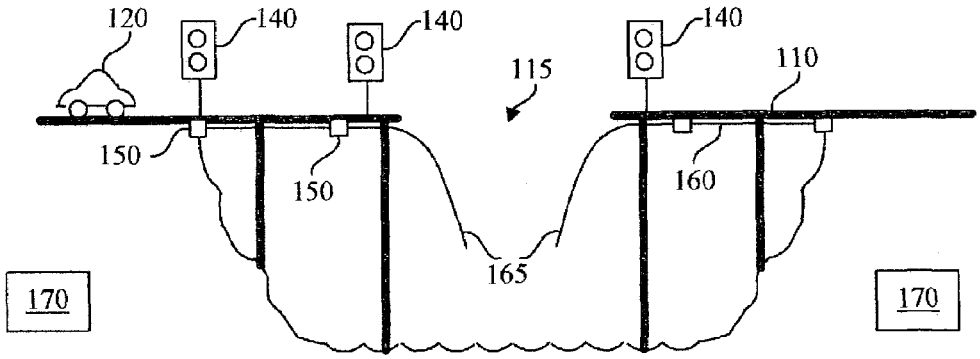
Prior Art FIG. 1
FIG. 1 is an elevation view illustrating prior art of a bridge with a failed span.

FIG. 1 is an elevation view illustrating prior art of a concrete bridge causeway with a failed span. Bridge 110 at some time may have a failed bridge span 115 caused by collision by a boat or barge. Approaching vehicle 120 may have no means for becoming aware of failed bridge span 115 due to poor lighting conditions (night, sun near the horizon, or road glare) or due to a low viewing angle. Approaching vehicle 120 may eventually become aware of a bridge failure which happened minutes or even hours before, but have insufficient stopping distance due to travel at highway speeds. When approaching vehicle 120 careens off of failed bridge span 115 there is a loss of property and a likely loss of life. Approaching vehicle 120 may include an automobile, bus, truck, train, bicycle, motorcycle, or pedestrian.

Fiber optic cable 160 is periodically attached to bridge 110 by cable anchors 150. The failed bridge span 115 will over-stretch fiber optic cable 160, creating parted fiber optic cable 165, detected by alarm indicator controller 170, activating user indicator 140, warning approaching vehicle 120 to immediately stop, preventing further loss of life or property. User indicator 140 may consist of any combination of a red traffic signal, a railroad crossing gate, highway message board message, tire spikes, flare, horn, 911 dispatch, traffic radio, or other means to indicate upcoming danger to approaching vehicle 120. User indicator 140 may also be a green light, indicating the lack of a failure. Parted fiber optic cable 165 is operable only by stretching the cable conductor beyond its elastic modulus by increasing the distance between two fixed cable anchors 150. Thus it is highly important that fiber optic cable 160 be securely attached to bridge 10 by cable anchor 150.

Cable anchors 150 are spaced at less than a maximum spacing on bridge 110. A typical fiber optic cable 160 will stretch approximately 0.3% before breakage. Additionally, fiber optic cable 160 is subject to thermal contraction and expansion. Enough extra fiber optic cable 160 must be left between cable anchors 150 to ensure the fiber optic cable does not break during thermal extremes. Maximum spacing between cable anchors 150 is determined such that the total elongation of fiber optic cable 160 between two cable anchors 150 caused by failed bridge span 115 must be greater than the maximum cable stretch to guarantee creation of a parted cable 165 minus worst case thermal allowance minus any initial slack minus any safety margin. Generally, the elongation caused by failed bridge span 115 is a function of the elevation of the bridge above the level of the earth and length of the bridge span. A typical distance between cable anchors 150 with a 15 foot fall of failed bridge span 115 is 900 feet. Taller bridges can tolerate a larger distance between cable anchors. Typical fiber optic cable for communications consists of multiple glass optical fibers, each inside of a plastic buffer tube. The buffer tube protects the fibers from nicking, scratching, and breaking due to normal handling. Typically, the buffer tubes are surrounded by an aramid yarn then a plastic outer sheath to compose a cable. The aramid yarn allows the optical fibers to very easily slip within the plastic outer sheath. Cable anchor 150 prevents any significant creep or slippage of the optical fibers within the cable. Without cable anchor 150, the fiber may slip within the cable sheath and not be guaranteed to break upon structural failure.

Alarm indicator controller 170 indicates the status of the system to maintenance personnel.

Figure 2A:
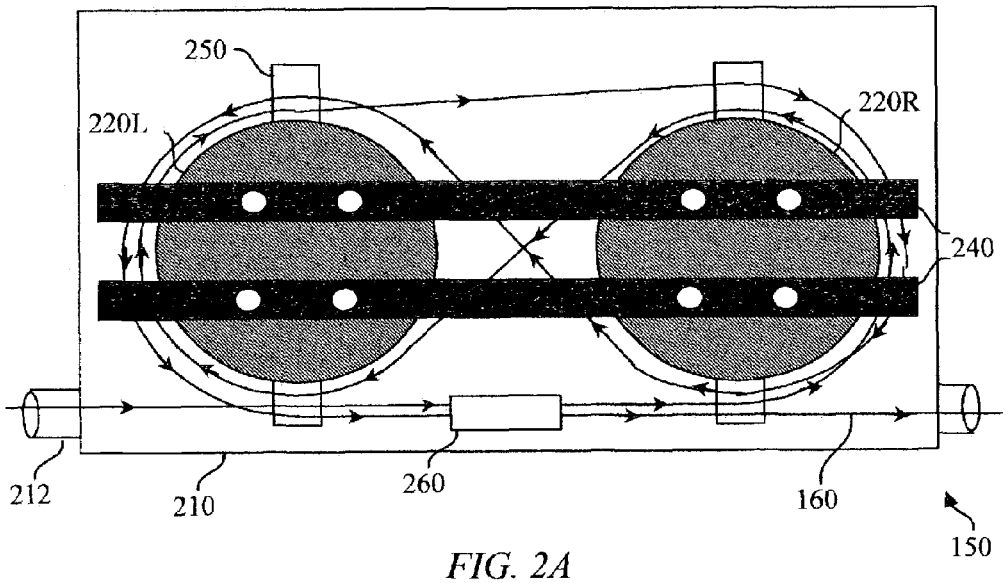
FIG. 2A is a plan view of a cable anchor in accordance with the present invention.

FIG. 2A is a plan view of a cable anchor. Cable anchor 150 consists of box 210 containing two spindles 220. Box 210 may be a condulet. Box 210 is anchored to bridge 110. Optionally, fiber optic cable 160 may be run in conduit 212. Alternatively, conduit 212 may be eliminated by attaching fiber optic cable 160 to a messenger strand or by epoxying fiber optic cable 160 directly to the structure.

Fiber optic cable 160 enters box 210 on the lower left side of FIG. 2A, is contacted at clamp 260, fibers spindled counterclockwise around the right spindle 220R, clockwise around left spindle 220L, straight across to right spindle 220R, clockwise around right spindle 220R, counterclockwise around left spindle 220L, is clamped again at clamp 260, and exits box 210 on the lower right side. Fiber optic cable 160 is always in contact with spindle 220 but shown offset for clarity. There is vertical separation between windings, thus no fiber overlap. Clockwise turns are compensated by counterclockwise turns, since spindling a cable adds either right hand or left hand twist, respectively. Net twist on fiber optic cable 160 is zero. The number of clockwise and counterclockwise turns on each spindle are equal, creating no net torque on the spindle, as the failing structure pulls from only one end. Other cable spindling configurations are available with no net twist and no net spindle torque. The distance between spindles 220 may be adjusted to utilize a variable length of fiber optic cable 160 by varying the position on unistrut 240. Additional turns may be added by repeating the above winding pattern. The number of turns of fiber optic cable 160 are selected such that friction between the optical fiber within fiber optic cable 160 and spindle 220 is greater than the tensile strength of optical fiber. Surface coatings including rubber, teeth, or knurling may be added to spindles 220 to further increase friction, thus reducing the number of required turns. Retainer clips 250 ensure optical fibers remain in place on spindles 220. Retainer clips 250 may be cotter pins. Advantages include: spindles do not create any point stresses to damage the glass fiber during normal operating or installation conditions; spindles will not nick or abrade the fiber during normal vibration; spindles allow easy sectionalization of a structure to guarantee the cable will break, not stretch, upon failure; spindles prevent any creep of fiber from one section to another section. The sheath and aramid of fiber optic cable 160 may be removed from the section in contact with spindles 220 to increase friction via direct contact between the buffered fiber within fiber optic cable 160 and spindle 220. Cable clamp 260 dampens vibration and relieves the stress of the cable discontinuity due to the cut sheath. Upon failure of the structure, the failing structure will elongate the cable, producing tension on the glass fibers until the tensile strength has been exceeded and the signal on the glass fiber will be interrupted. The spindle anchors the cable to a fixed point, preventing this tension from propagating down the cable. Static tension on fiber optic cable 160 is not required, but can increase sensitivity to elongation, as the cable is prestretched during installation. Static tension may be approximately 20 pounds. Advantages of pre-stretching are a reduction of the number of cable anchors 150 required for a long bridge 110 or an increased sensitivity to bridge movement. An advantage of cutting the cable sheath is to reduce the tension required to break the fibers and thus reduce the mounting hardware requirements. An advantage of removing the aramid is to remove a slip layer, allowing friction directly with the buffered fibers, preventing creep.

Figure 2B:
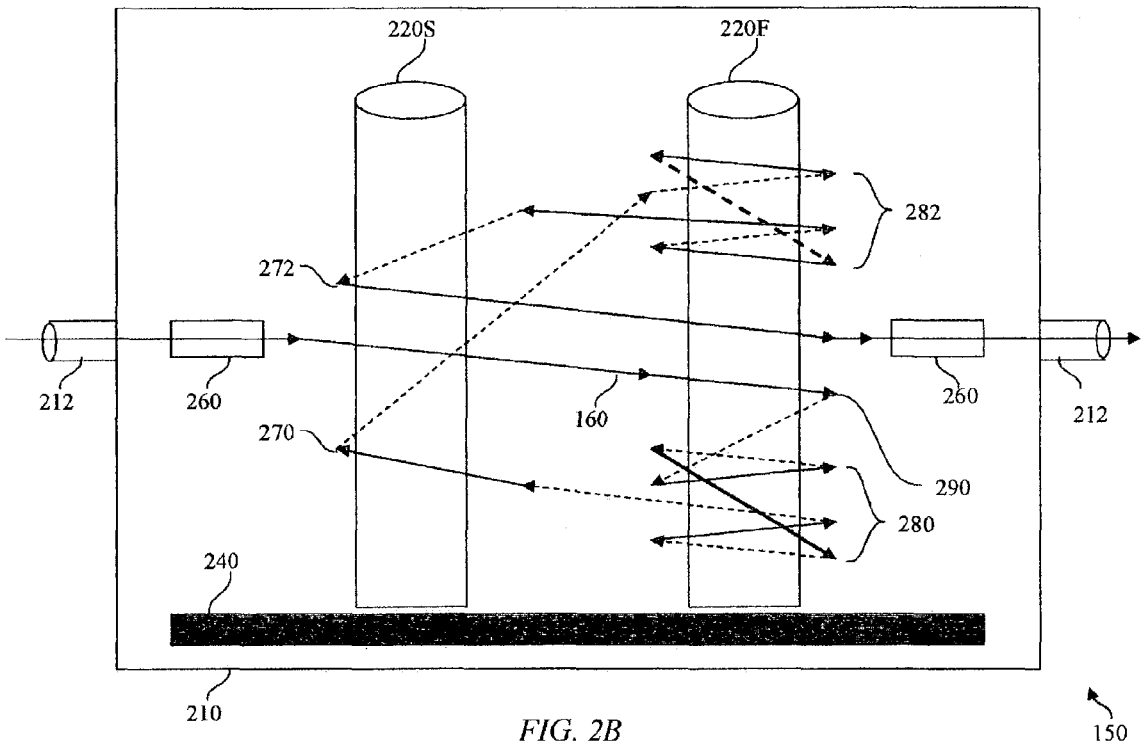
FIG. 2B is a side view of an alternate embodiment of a cable anchor in accordance with the present invention.

FIG. 2B is a side view of an alternate embodiment of a cable anchor where the fiber cable spindling includes a knot. The plan view of this embodiment is similar to that in FIG. 2A. A right hand, upward pointing, double constrictor knot 280 is placed on a first fixed spindle 220F. A clockwise loop 270 is placed on a second free rotating spindle 220S. A left hand, upward pointing, double constrictor knot 282 is placed on a first fixed spindle 220F. A counterclockwise loop 272 is placed on a second free rotating spindle 220S. Extra loop 290 is required due to the asymmetry of only placing constrictors on one spindle. This prevents the constrictor from deforming into an executioners knot with small amounts of rotation of the spindle (conversion of axial tension to radial tension) caused by the knots pulling tight. An advantage is the net twist in fiber optic cable 160 is near zero due to opposite hand knots. Another advantage is net torque on fixed spindle 220 due to tension on fiber optic cable 160 is near zero due to the use of opposite hand, same pointing knots. Yet another advantage is offset of fiber optic cable 160 is the same at the input and output. Many different configurations of knots on one or more spindles can be easily envisioned. A variety of knots including constrictor knots or hitches may be used. Advantages are: the knots are self-tightening, thus increasing friction between the fiber and the spindle with increasing tension; it does not change form with increasing tension, keeping forces on the fiber in tension; and chances of breaking the fiber under unintentional conditions are minimized. Both fixed spindle 220F and free rotating spindle 220S may be mounted to unistrut 240 to slightly vary position along the bridge in order to remove any cable slack during installation. Cable clamps 260 may be placed to aid in installation. An advantage of using a knot is that cutting the fiber optic cable sheath or aramid is not required, thus environmental integrity is maintained, handling damage during maintenance is minimized, and there is no discontinuity down the elongation sensor length of fiber optic cable thus reducing the chance of unintentional failure of the fiber. Yet another advantage that is this method is suitable for use with both gelled and loose buffered cable. An advantage of gelled cable is its superior ability to withstand attack from environmental moisture.

In another embodiment, only the sheath of the cable is removed. The aramid and fibers are spindled once around a single post. A plastic encapsulation mould is placed around the post. Scotchcast™ encapsulant is cast around the spindled fiber and aramid. An advantage is that the area of the fiber with the sheath removed is resealed against environmental harms and to damage after installation.

In another embodiment, a spindle consists of a slightly compressible foam cylinder. Within the foam cylinder, one or more razor blades are set radially within the cylinder. The blade depth is set slightly below the surface of the foam at a depth sufficient to prevent the fiber cable from contacting the blade with foam compression due to normal cable tension. Blade pitch may be offset from a true radius, as to dig into and cut the cable upon application of cable tension. Cable tension will cause the foam to compress, thus exposing the blade to the fiber.

In yet another embodiment, the sheath of fiber optic cable 160 is slit and a cyannoacrylate material is added to the aramid yarn to glue the fiber to the sheath within fiber optic cable 160. Fiber optic cable is spindled before the glue can set. An advantage of gluing the fiber to the sheath is that fewer turns on the spindle are required.

In yet another alternate embodiment, fiber optic cable 160 is in an alternating series of clockwise and counterclockwise half turns, creating a serpentine pattern. The serpentine pattern may be distributed in the jaws of a clamp. An advantage is that the distributed spindling requires less time to install on a new structure.

In yet another embodiment, fiber optic cable 160 is anchored to a fixed point with a cable-pulling Kellum grip.

Figure 3:
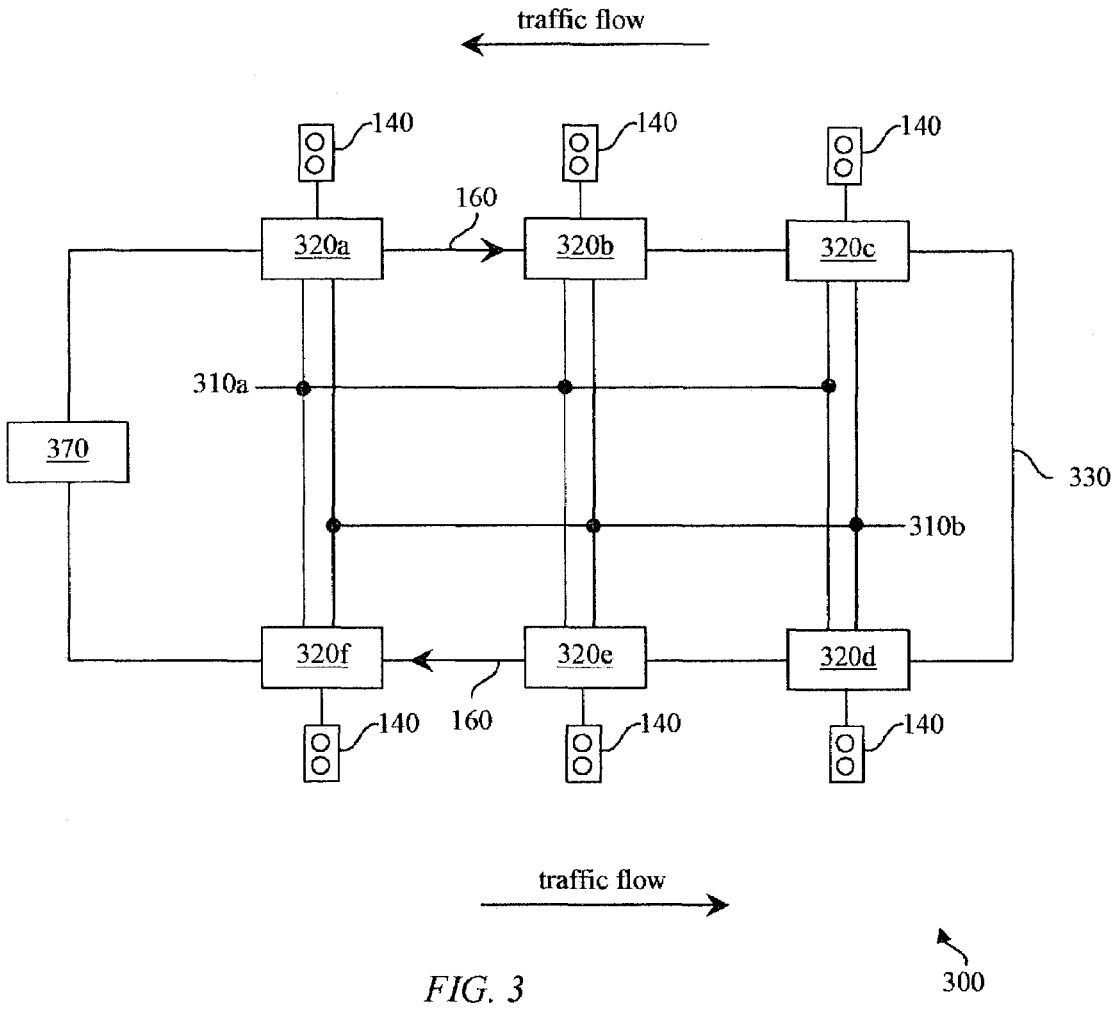
FIG. 3 is a signal flow diagram of one embodiment of an indicator control system in accordance with the present invention.

FIG. 3 is a signal flow diagram of one embodiment of an indicator control system. User indicators 140 may or may not be placed at the same locations as cable anchors 150. Alarm indicator controllers 320 may or may not be placed at the same location as cable anchors 150 or user indicators 140. Alarm indicator controller 320 is comprised of a microcontroller, a fiber optic signal source and a fiber optic detector.

Maintenance unit 370 generates a data pattern containing a header and a command sequence. Bridge traffic flow is in the opposite direction of data flow through alarm indicator controllers 320. Alarm indicator controller 320*a* receives a signal from maintenance unit 370. Alarm indicator controller 320*a* performs any command from maintenance unit 370 and generates a response. Alarm indicator controller 320*a* transmits a signal on fiber optic cable 160 containing a header, the data pattern from maintenance unit 370, and response from a command, if any. Alarm indicator controllers 320*b–f* perform the same functions as alarm indicator controller 320*a*, but at different locations along the structure. Alarm indicator controllers 320 may be arranged in a ring. For instance, if no data arrives at alarm indicator controller 320*b*, it is determined that the bridge has failed between alarm indicator controller 320*a* and alarm indicator controller 320*b*, and any approaching vehicle 120 located at or after alarm indicator controller 320*b* must be warned immediately. Alarm indicator controller 320*b* transmits no data to alarm indicator controller 320*c–f*. Data is looped back at remote loopback cable 330. An alternate embodiment for a single bridge, instead of a divided structure, may terminate into a second maintenance unit 370. Alarm indicator controller 320*c*, located at the traffic ingress of the other traffic direction of the bridge, is capable of generating null data, even if it has no input data, if installed on a divided causeway, and allows traffic to continue to flow in the opposite traffic flow direction. In this event, a railroad gate may be closed on the ingress side of the still functioning span at alarm indicator controller 320*f* to allow manual inspection of the bridge before additional traffic is allowed, in case debris from the initial collapse may have caused latent damage to this traffic flow direction. Alternate embodiments may have more or fewer alarm indicator controllers 320. Some advantages of alarm indicator controllers midspan on the bridge are shorter runs of fiber optic cable, easy replacement of cable if damaged, and significant optical link power budget margin even on long bridges.

Maintenance unit 370 displays the status of all alarm indicator controllers 320 to maintenance personnel or sends data to command any alarm indicator controller 320 to perform a user indicator 140 activation or other test function. Alarm indicator controllers 320 are connected in a serial fashion, with data circulating in a self-clocked shift register fashion. Alarm indicator controllers 320 are capable of establishing their address in the system by counting the number of bytes between the header and a token placed on the serial bus by maintenance unit 370 during initialization. If the alarm indicator controller 320 has not had its address configured it will remove the token, assign its id as the number of bytes counted, and pass all future tokens. Commands to the alarm indicator controllers may include reporting local temperature, power line voltage, power line current, ambient lighting, battery charge, inclination of the bridge span; or to activate the signal or battery discharge for test purposes. In an alternate embodiment, maintenance unit 370 may be omitted or all data patterns substituted with other signals. Maintenance unit 370 may communicate via recorded message to 911 service, dial up modem, Ethernet, or other means.

Electrical power to operate user indicators 140 and alarm indicator controllers 320 may be delivered through power cable 310*a* or power cable 310*b*. Multiple power cables, each sourced from the opposite end of the bridge, allow for power source redundancy. Alternatively, one power source may be used without redundancy. Power cable 310 may be integral to fiber optic cable 160, run in conduit 212 alongside fiber optic cable 160, or may take an alternate path. Energy storage may be present at user indicators 140 or alarm indicator controllers 320, since power cable 310 may be shorted or opened during a bridge failure. Without local energy storage, an interrupted power source may render user indicators 140 incapable of warning approaching vehicle 120 at the time they are most needed. In an alternate embodiment, energy storage is always present at user indicators 140 and power cable 310 is reduced in wire gauge to be only capable of supplying quiescent power for user indicators 140 when not indicating a failure plus a small margin to charge the energy storage device. The alarm indicator controller consumes approximately 1 W of quiescent power and an additional 12 W when powering a red traffic signal light. Advantages of energy storage located near a controller are reduced wire gauge and associated cost, reduced cost associated with fewer or smaller conduits, and a simultaneous conduit pull of both electrical and fiber cables.

Additional embodiments combine multiple indicator control systems 300 with the same or opposite direction of signal flow for redundancy. Other embodiments may place multiple indicator control systems 300 in series for fault isolation.

Figure 4:
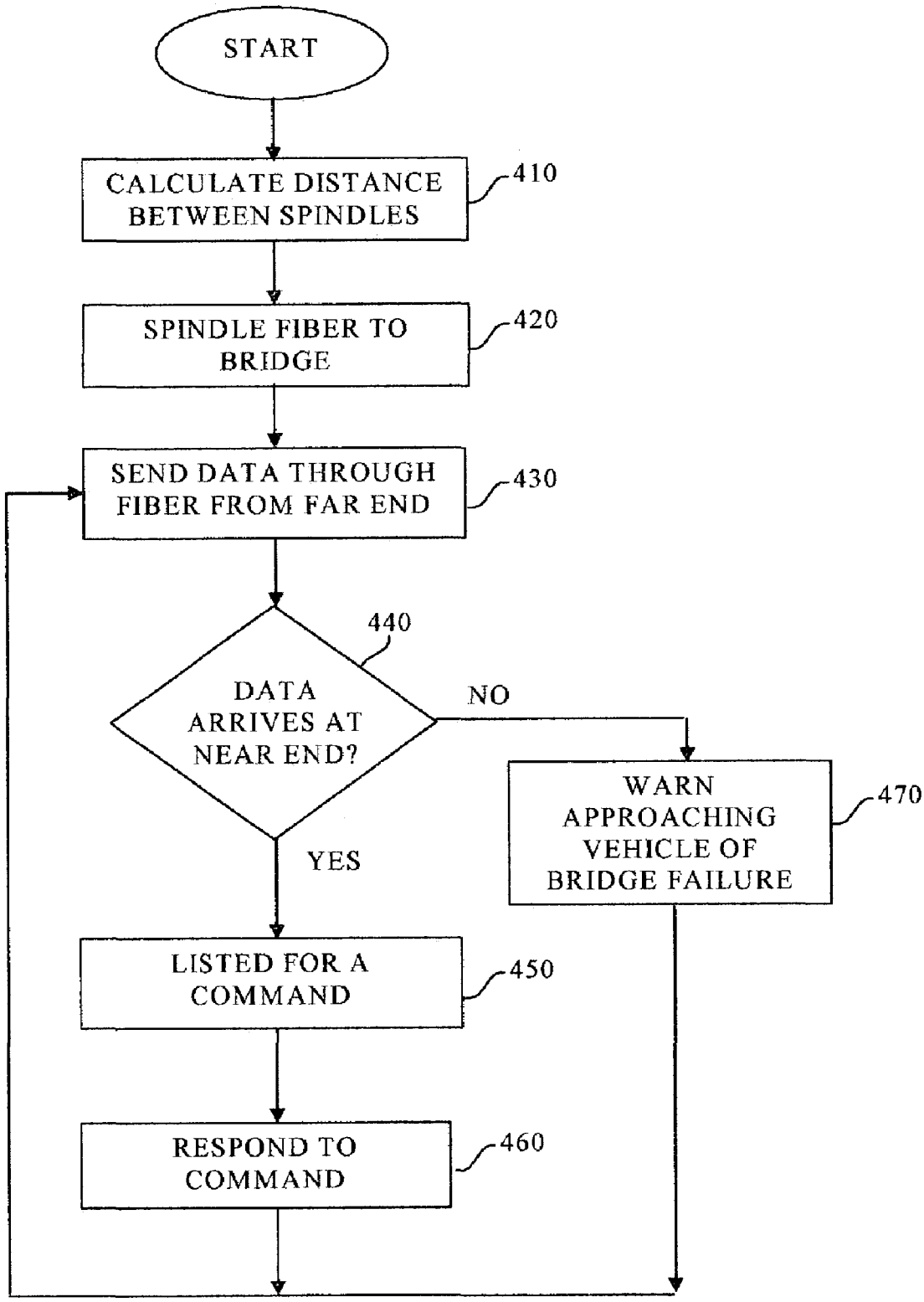
FIG. 4 is a flowchart demonstrating one method of detecting a structural failure in accordance with the present invention.

FIG. 4 is a flowchart demonstrating one method of detecting a structural failure. Calculate the distance between cable anchor locations such that the maximum stretch before breakage, including a safety margin, of a selected fiber optic cable and cable anchor is less than the change in cable length caused by the failing structure in step 410. Attach a fiber optic cable to the structure to be monitored using spindles at the calculated locations in step 420.

Send data through the fiber optic cable in step 430. Check if data arrived at the next controller in step 440. If data arrives, the structure has not failed. Perform any requested commands in step 450 and reply in step 460. Proceed back to step 430. If no data arrives in step 440, the fiber is broken, likely due to stretching beyond its tensile strength limit. Immediately warn approaching vehicle 120 of the structural failure in step 470. Proceed back to step 430. The process of sending data and monitoring for its receipt repeats indefinitely, so long as the structure is being monitored for failure.

Although embodiments of the invention and their advantages are described in detail, a person skilled in the art could make various alterations, additions, and omissions without departing from the spirit and scope of the present invention as defined by the appended claims.

What is claimed is:

1. A system for detecting a structural failure comprising:
a cable;
a set of two or more spindles operable to anchor said cable to said spindle set;
two or more said spindle sets anchored to a structure at an interval to ensure break due to over-elongation of said cable upon failure of the structure;
a single signal source coupled to one end of said cable; and
a single signal detector coupled to the opposite end said cable.

2. The system of claim 1, where said cable is fiber optic.

3. The system of claim 1, where said cable is pre-stretched to increase system sensitivity or increase distance between spindle anchor locations.

4. The system of claim 1, where said cable carries a data signal.

5. The system of claim 1, where the distance between said spindles within said spindle set is adjustable to remove any slack from the cable.

6. The system of claim 5, where said cable is spindled such to produce no net cable twist.

7. The system of claim 5, where said cable is spindled such to produce no net spindle torque.

8. The system of claim 1, where the spindle surface of said spindle has increased friction with said cable or conductors within said cable, comprised of at least one of the following:
an organic coating;
an encapsulation;
compression;
knurling;
teeth; or
a blade.

9. The system of claim 1, where said signal detector is coupled to one of the following user indicators:
a red traffic signal;
a railroad gate
a horn.

10. The system of claim 1, where multiple said detection systems are placed in series.

11. The system of claim 1, with redundant said detection systems.

12. The system of claim 11, where the signal carries a digital data signal and a controller coupled to said signal source and said signal detector are operable to respond to diagnostic commands.

13. The system of claim 12, further comprising an independent backup power source for each said signal source and said signal detector.

14. The system of claim 12, where said system is coupled with off-site maintenance and emergency response services.

15. The system of claim 12, where said system provides information either automatically or by request via voice or data connection.

16. A system for detecting structural failure comprising;
a fiber optic cable coupled to a structure;
a multitude of alarm indicator controllers where said controller monitors for a break in said fiber optic cable;
a multitude of user indicators; and
at least one of said controllers is located within the housing of at least one said user indicator.

17. The system of claim 16, further comprising an independent backup power source for each said controller, located within the housing of each said controller.

18. The system of claim 16, where said controller is operable to respond to diagnostic commands operable to individually test each of said user indicators.

19. The system of claim 16, where said controller is attached to said structure and contains an inclinometer located within the housing of said controller.

20. A system for detecting structural failure comprising:
a means for attaching a fiber optic cable to a structure such that failure of said cable indicates a failure of said structure;
a means for anchoring said cable to said structure such that said cable will not slip or creep past an attachment point; and
a means for monitoring for a break of said cable.

21. The system of claim 20, where the means for attaching said cable to said structure will not allow more than 1 inch of slip or creep past said attachment point with said cable under continuous tension.

22. The system of claim 20, where said spindle means comprises at least two spindles with said cable wound such that there is no net twist in said cable.

23. The system of claim 20, where said spindle means comprises at least two spindles with a cable wound such that there is no net torque on said spindles.

24. The system of claim 20, where said fiber spindling means forms a knot.

25. The system of claim 24, where said knot is of the constrictor family.

26. The system of claim 20, where said spindle means includes a surface treatment for increasing friction between said cable and said spindle.

27. The system of claim 20, where said means of anchoring said cable to said structure includes at least one turn on a pin, retained with encapsulant.

28. A means for detecting structural failure comprising:
two or more fiber optic cable segments, each segment coupled to a signal source and signal detector;
a means for anchoring said fiber optic cable to a structure such that the failure of said fiber optic cable correlates with failure of said structure;
where said means for anchoring said fiber optic cable includes a spindle means operable to prevent said cable from slipping past an anchor point and prevents said cable from being broken by said anchor means under tensile forces slightly less than the tensile strength limit of said fiber optic cable:
a means to operate user indicators and controllers along the structure; and
a means to provide electric power to each signal source and signal detector.

29. The means of claim 28, where the means for providing electric power is insufficiently sized to continuously power said user indicators and an energy storage means to sufficiently power said user indicator are located within each controller or user indicator.

30. The means of claim 28, where a means for monitoring the status of said energy storage means is coupled to maintenance services via said controllers.

31. The means of claim 28, where a means for monitoring the inclination of a structural component is provided within said controller.

32. A method for detecting a structural failure comprising:
providing a fiber optic cable attached to said structure such that said cable cannot slip past fixed points;
and said fiber optic cable will be parted by said structural failure; and providing indication of said structural failure to a user of a multiple points along said structure.

33. The method of claim 32, where said cable cannot slip past any of said fixed points by more than 6 inches.

34. The method of claim 32, further comprising, providing a spindle to attach said cable to said fixed point.

35. The method of claim 34, further comprising, providing a spindle set suitable to:

take up any cable slack during installation;

provide a cable winding such that the spindles have no net torque;

provide a cable winding such that the cable has no net twist; or provide friction between the spindle and the optical fiber adequate to break the fiber.

36. The method of claim 34, further comprising a knot placed on said spindle.

37. The method of claim 32, where said controller is operable to respond to diagnostic commands operable to individually activate and monitor each of said user indicators.

38. The method of claim 32, where said energy storage is located within said user indicator sufficient to indicate failure to said user for at least 30 minutes;

and maximum electrical power input is slightly greater than quiescent power input.

* * * * *